US010196714B2

(12) United States Patent
Nam et al.

(10) Patent No.: US 10,196,714 B2
(45) Date of Patent: Feb. 5, 2019

(54) SHAPE MEMORY ALLOY COMPRISING TI, NI AND SI

(71) Applicant: INDUSTRY-ACADEMIC COOPERATION FOUNDATION GYEONGSANG NATIONAL UNIVERSITY, Gyeongsangnam-do (KR)

(72) Inventors: Tae-Hyeon Nam, Gyeongsangnam-do (KR); Gyu-bong Cho, Gyeongsangnam-do (KR)

(73) Assignee: INDUSTRY-ACADEMIC COOPERATION FOUNDATION GYEONGSANG NATIONAL UNIVERSITY, Gyeongsangnam-Do (KR)

( * ) Notice: Subject to any disclaimer, the term of this patent is extended or adjusted under 35 U.S.C. 154(b) by 0 days.

(21) Appl. No.: 15/307,275

(22) PCT Filed: Nov. 17, 2014

(86) PCT No.: PCT/KR2014/011039
§ 371 (c)(1),
(2) Date: Oct. 27, 2016

(87) PCT Pub. No.: WO2016/076466
PCT Pub. Date: May 19, 2016

(65) Prior Publication Data

US 2017/0240995 A1 Aug. 24, 2017

(30) Foreign Application Priority Data

Nov. 14, 2014 (KR) ..... 10-2014-0159121

(51) Int. Cl.
*C22C 14/00* (2006.01)
*C22C 19/03* (2006.01)
*C22C 19/00* (2006.01)

(52) U.S. Cl.
CPC ..... *C22C 19/03* (2013.01); *C22C 14/00* (2013.01); *C22C 19/007* (2013.01)

(58) Field of Classification Search
None
See application file for complete search history.

(56) References Cited

U.S. PATENT DOCUMENTS 4,713,643 A * 12/1987 Baum ..... H01H 71/145 337/140
5,419,788 A * 5/1995 Thoma ..... C22F 1/006 148/402

(Continued)

FOREIGN PATENT DOCUMENTS

JP S6237353 A 2/1987
JP 06072285 B2 9/1994

(Continued)

OTHER PUBLICATIONS

Translation of JP 62-037353 (published Feb. 18, 1987) from J-Plat Pat.*

(Continued)

*Primary Examiner* — George Wyszomierski
(74) *Attorney, Agent, or Firm* — Ohlandt, Greeley, Ruggiero & Perle, L.L.P.

(57) ABSTRACT

Disclosed is a shape memory alloy. The shape memory alloy is composed of Ti, Ni and Si, wherein Si is contained in an amount of 0.1 to 0.3 at. %.

7 Claims, 22 Drawing Sheets

| COMPOSITION | $M_s$ Temperature(℃) |
|---|---|
| Ti-50Ni | 41.5 |
| Ti-49.9Ni-0.1Si | 81.9 |
| Ti-49.8Ni-0.2Si | 80.8 |
| Ti-49.7Ni-0.3Si | 72.3 |
| Ti-49.5Ni-0.5Si | 31.4 |
| Ti-49.3Ni-0.7Si | 47.8 |

(56) References Cited

U.S. PATENT DOCUMENTS 5,975,468 A * 11/1999 Moignier ..... F03G 7/065
244/172.7
2006/0037672 A1 2/2006 Love et al.

FOREIGN PATENT DOCUMENTS

JP 3013384 B2 2/2000
KR 102006 0126896 A 12/2003
KR 1020120127965 A 11/2012

OTHER PUBLICATIONS

Nam et al; "Phase Transformation Behavior and Shape Memory Characteristics of Ti-(50-x) Ni—xSi (x=0. 0.1, 0.2, 0.3, 0.5, 0.7 at%) Alloys According to Change of Si Concentration"; Fall Conference of the Korean Institute of Metals and Materials (2014); pp. 2-11.
International Search Report dated Jul. 22, 2015 for PCT application No. PCT/KR2014/011039.
Written Opinion dated Jul. 22, 2015 for PCT application No. PCT/KR2014/011039.
Kim et al; "Shape Memory Characteristics of Thermo-Mechanically Treated and Aged Ti—Ni—Si Alloys"; Gyeongang National University, Division of Materials Science and Engineering and ReCapt, vol. 39, No. 6; Feb. 14, 2001; pp. 635-640.
Korean Office Action dated Oct. 27, 2015 for Korean application No. 10-2014-0159121.

* cited by examiner

| COMPOSITION | $M_s$ Temperature(℃) |
|---|---|
| Ti-50Ni | 41.5 |
| Ti-49.9Ni-0.1Si | 81.9 |
| Ti-49.8Ni-0.2Si | 80.8 |
| Ti-49.7Ni-0.3Si | 72.3 |
| Ti-49.5Ni-0.5Si | 31.4 |
| Ti-49.3Ni-0.7Si | 47.8 |

| POINT ANALYSIS (%) | | | |
|---|---|---|---|
| Average | Si | Ti | Ni |
| ① BASE | - | 50.324 | 49.676 |
| ② GRAY | 14.200 | 50.630 | 35.172 |
| ③ BLACK | 8.394 | 51.800 | 37.360 |

| AREA ANALYSIS (%) | | | |
|---|---|---|---|
| | Si | Ti | Ni |
| Average | 0.324 | 50.255 | 49.415 |

| POINT ANALYSIS (%) | | | |
|---|---|---|---|
| Average | Si | Ti | Ni |
| ① BASE | - | 50.242 | 49.758 |
| ② GRAY | 11.482 | 51.074 | 37.442 |
| ③ BLACK | 8.388 | 50.286 | 41.330 |

| AREA ANALYSIS (%) | | | |
|---|---|---|---|
| | Si | Ti | Ni |
| Average | 0.555 | 49.860 | 49.585 |

| POINT ANALYSIS (%) | | | |
|---|---|---|---|
| Average | Si | Ti | Ni |
| ① BASE | - | 50.268 | 49.732 |
| ② GRAY | 14.348 | 51.400 | 34.252 |
| ③ BLACK | 8.738 | 51.036 | 40.222 |

| AREA ANALYSIS (%) | | | |
|---|---|---|---|
| | Si | Ti | Ni |
| Average | 0.765 | 51.435 | 47.800 |

SHAPE MEMORY ALLOY COMPRISING TI, NI AND SI

TECHNICAL FIELD

The present invention relates to a shape memory alloy composed of Ti, Ni, and Si, and more particularly, to a high-temperature shape memory alloy in which Si is added to a shape memory alloy of Ti—Ni binary system.

BACKGROUND ART

As alloys representing a shape memory effect, Au—Cd, Ti—Ni, Cu—Al—Ni, Ag—Cd, Fe—Pt, Cu-Zu, Cu—Au—Zn, and the like had been reported. In practical terms, a Ti—Ni-based alloy having excellent shape memory effect stability and mechinability had been known as the dominant alloy.

However, the shape memory alloy of Ti—Ni binary system has a transformation temperature in a range of 330 to 220 K, and is not yet employed to parts of high-temperature home appliances, automobiles, aircrafts, high-temperature actuators, and the like which are exposed to a temperature larger than the transformation temperature. To overcome this, researches for the development of high-temperature shape memory alloys were conducted. Specifically, it had been known that the transformation temperature is increased when elements such as Pd, Pt, Au, or Hf are added to the Ni—Ti binary alloy.

However, since the elements such as Pd, Pt, Au, or Hf are very expensive, it was difficult to practice the high-temperature shape memory alloy using the elements.

DETAILED DESCRIPTION OF THE INVENTION

Technical Problem

The present invention has been made in view of the above problems, and an object of the present invention is to provide a low-priced high-temperature shape memory alloy in which Si is added to a shape memory alloy of Ti—Ni binary system.

Technical Solution

To obtain the above-described object, the present invention is to provide a shape memory alloy composed of Ti, Ni, and Si, wherein Si is contained in an amount of 0.1 to 0.3 at. %.

The shape memory alloy may be composed of 50Ti-(50−x)Ni-xSi (at. %) ($0.1 \leq x \leq 0.3$).

The shape memory alloy may be composed of 50.2Ti-(49.8−x)Ni-xSi (at. %) ($0.1 \leq x \leq 0.3$).

The shape memory alloy may have a martensitic transformation start temperature $M_s$ in a range of 70° C. to 90° C.

Phase transformation to an R (rhombohedral) phase from a B2 (cubic) phase in the shape memory alloy may occur in a specific temperature range.

The phase transformation may occur in a temperature range of between 60° C. to 75° C.

An actuator which operates according to temperature change may be composed of the above-described shape memory alloy according to an embodiment of the present invention.

Effect of the Invention

According to the above-described various embodiments, a high-temperature shape memory alloy may be obtained without use of high-priced elements such as Pd, Pt, Au, Hf, and a high-temperature actuator using the high-temperature shape memory alloy may be manufactured.

MODE FOR INVENTION

Figure 1:
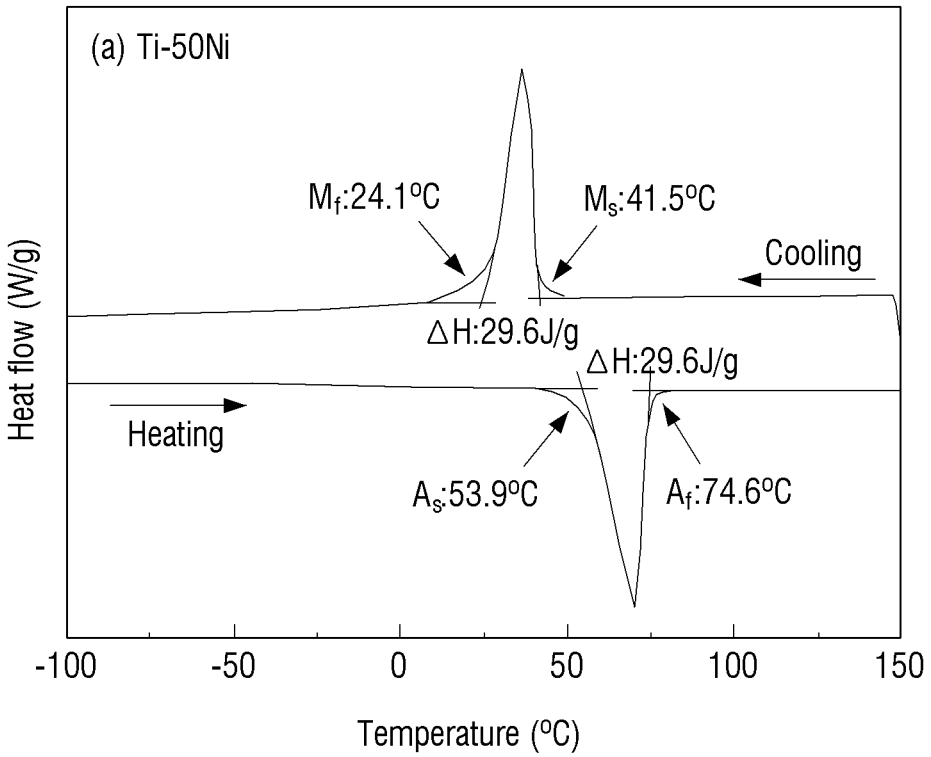
FIG. 1 is a diagram illustrating a differential scanning calorimetry result of a shape memory alloy according to a comparative example.

The present invention relates to a shape memory alloy. The shape memory alloy is an alloy having a shape memory effect (super elastic effect). The shape memory effect refers to a phenomenon that an alloy remembers its original shape at a high temperature, and when the alloy is cooled and deformed at a martensitic transformation start temperature $M_s$ or below, the alloy is not restored to the original shape and, when the alloy is heated to an austenitic transformation start temperature $A_s$ or more as a parent phase, the alloy is restored to its original shape.

The shape memory alloy according to various embodiments of the present invention is characterized in that the martensitic transformation start temperature $M_s$ of the alloy is increased by adding a small amount of Si to the Ti—Ni-based alloy which is a basic ingredient of the shape memory alloy. That is, the shape memory alloy of the present invention can operate at a high-temperature. Accordingly, the shape memory alloy of the present invention may be employed to parts of a high-temperature home appliance, an automobile, an aircraft, and the like.

In particular, the shape memory alloy of the present invention may be applied to an actuator. The actuator is a mechanical device used to move or control a system, and is a term extensively called a motor driving device using a variety of energy. When the actuator is composed of the shape memory alloy, the actuator operates through physical transformation of the shape memory alloy according to temperature change. For example, the actuator may be implemented with a switch capable of turning on/off according to the temperature change. The actuator composed of the shape memory alloy of the present invention is suitable for, specifically, a high-temperature actuator. Further, the shape memory alloy of the present invention may be used for a device such as a high-heat pipe fitting or a high-temperature sensor.

However, the shape memory alloy of the present invention is not limited to the above-described examples, and may be used for any device using the mechanical physical force according to the temperature change.

Hereinafter, preparing of a shape memory alloy and a property of the prepared alloy according to various embodiments of the present invention will be described.

To prepare an alloy, an alloy was prepared in an Ar atmosphere by dissolving sponge Ti (purity 99.7%), granular Ni (purity 99.9%), and Si (purity 99.9%) using an arc melting method. Five compositions of alloy were prepared: Ti-(50−x)Ni-xSi (x=0.1, 0.2, 0.3, 0.5, and 0.7) (at. %). As a comparative example, Ti—Ni which Si is not added thereto, that is, (50Ti-50Ni) was prepared. Here, the composition ratio of the alloy is represented by at. %.

The prepared alloy was maintained at 850° C. for 1 hour for the homogenization of a microstructure and an ingredient, was subjected to a cold solution treatment in the iced water, and was subjected to differential scanning calorimetry (DSC). To prevent oxidation of the sample, the alloys were tested while allowing nitrogen gas to flow at a rate of 80 ml/min. A cooling rate and a heating rate were 0.17 K/sec, and liquid nitrogen was used in the cooling. A temperature of an exothermic peak of a DSC curve was measured as a martensitic transformation temperature, and a temperature of an endothermic peak of the DSC curve was measured as an austenite transformation temperature. The results were shown in FIGS. 1 to 6.

FIGS. 1 to 6 are diagrams illustrating results of performing differential scanning calorimetry (DSC) after the solution treatment on the alloys according to the above-described compositions was performed at 850° C. for 1 hour to inspect a phase transformation behavior and a transformation temperature.

It can be seen from FIGS. 1 to 6 that when the Si content is within a specific range, the transformation start temperature $M_s$ is increased as compared with Ti—Ni of the comparative example.

Specifically, it can be seen from FIG. 1 that in Ti—Ni of the comparative example, the martensitic transformation start temperature $M_s$ is 41.5° C., the martensitic transformation finish temperature $M_f$ is 24.1° C., the austenite transformation start temperature $A_s$ is 53.9° C., and the austenite transformation finish temperature $A_f$ is 74.6° C.

Figure 2:
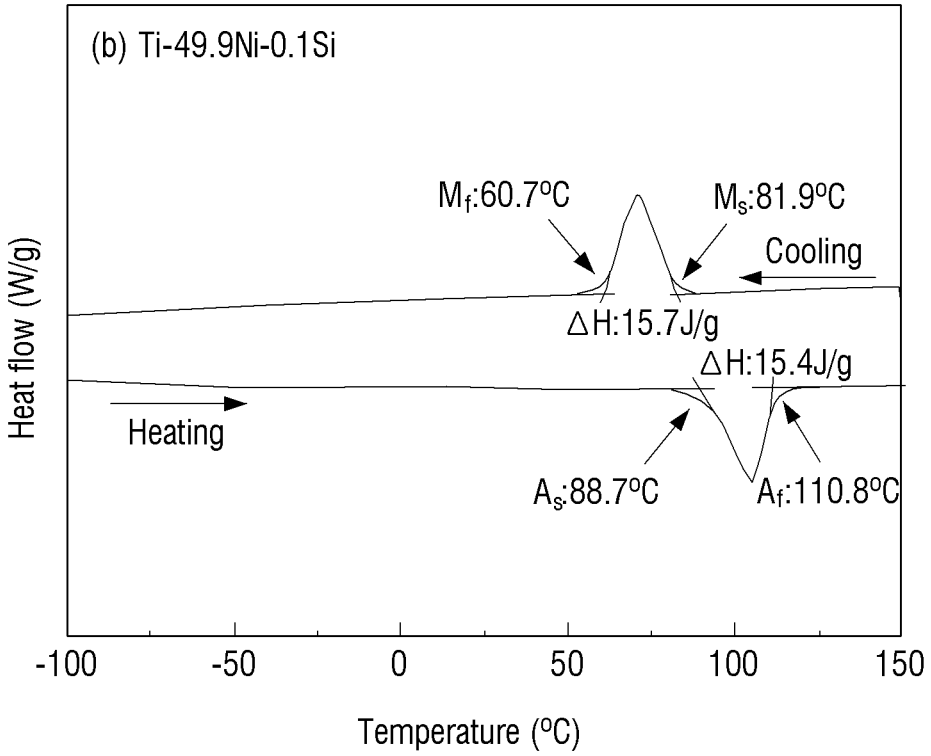
FIGS. 2 to 6 are diagrams illustrating differential scanning calorimetry results of shape memory alloys according to various embodiments of the present invention.

It can be seen from FIG. 2 that in 50Ti-49.9Ni-0.1Si, the martensitic transformation start temperature $M_s$ is 81.9° C., the martensitic transformation finish temperature $M_f$ is 60.7° C., the austenite transformation start temperature $A_s$ is 88.7° C., and the austenite transformation finish temperature $A_f$ is 110.8° C.

Figure 3:
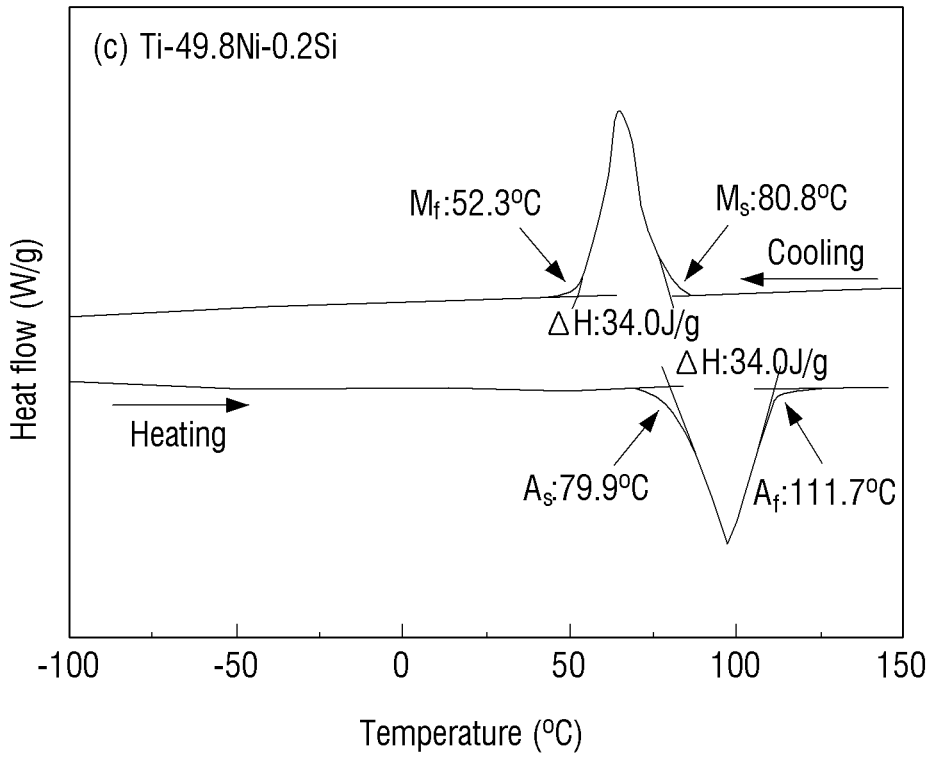

It can be seen from FIG. 3 that in 50Ti-49.8Ni-0.2Si, the martensitic transformation start temperature $M_s$ is 80.8° C., the martensitic transformation finish temperature $M_f$ is 52.3° C., the austenite transformation start temperature $A_s$ is 79.9° C., and the austenite transformation finish temperature $A_f$ is 111.7° C.

Figure 4:
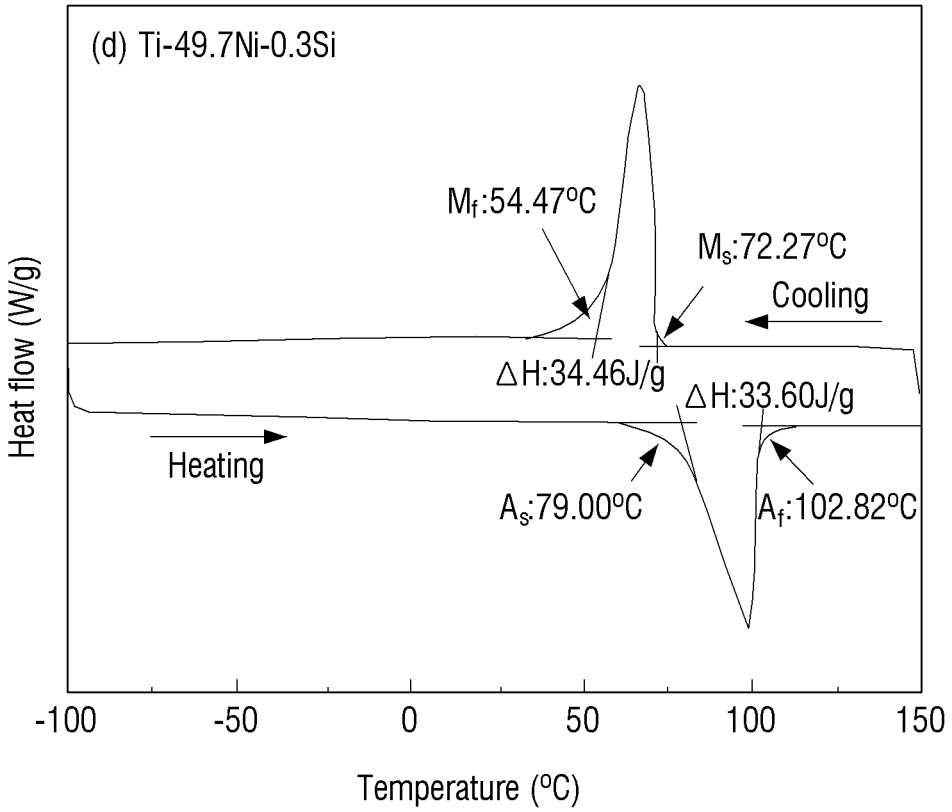

It can be seen from FIG. 4 that in 50Ti-49.7Ni-0.3Si, the martensitic transformation start temperature $M_s$ is 72.27° C., the martensitic transformation finish temperature $M_f$ is 54.47° C., the austenite transformation start temperature $A_s$ is 79.00° C., and the austenite transformation finish temperature $A_f$ is 102.82° C.

Figure 5:
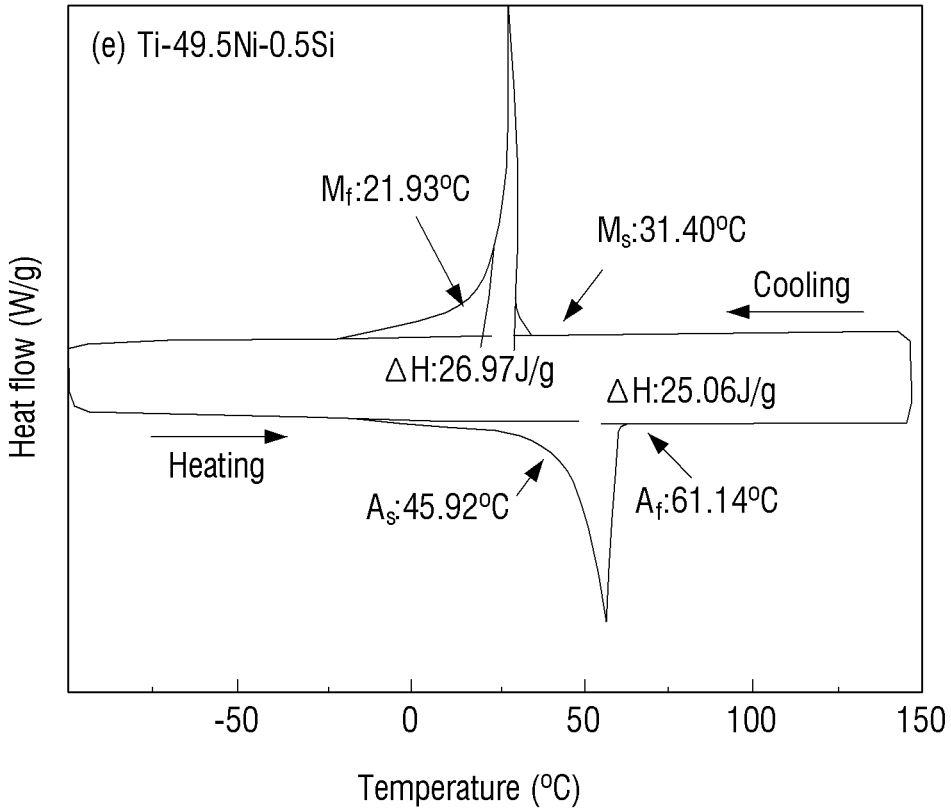

It can be seen from FIG. 5 that in 50Ti-49.5Ni-0.5Si, the martensitic transformation start temperature $M_s$ is 31.40° C., the martensitic transformation finish temperature $M_f$ is 21.93° C., the austenite transformation start temperature $A_s$ is 45.92° C., and the austenite transformation finish temperature $A_f$ is 61.14° C.

Figure 6:
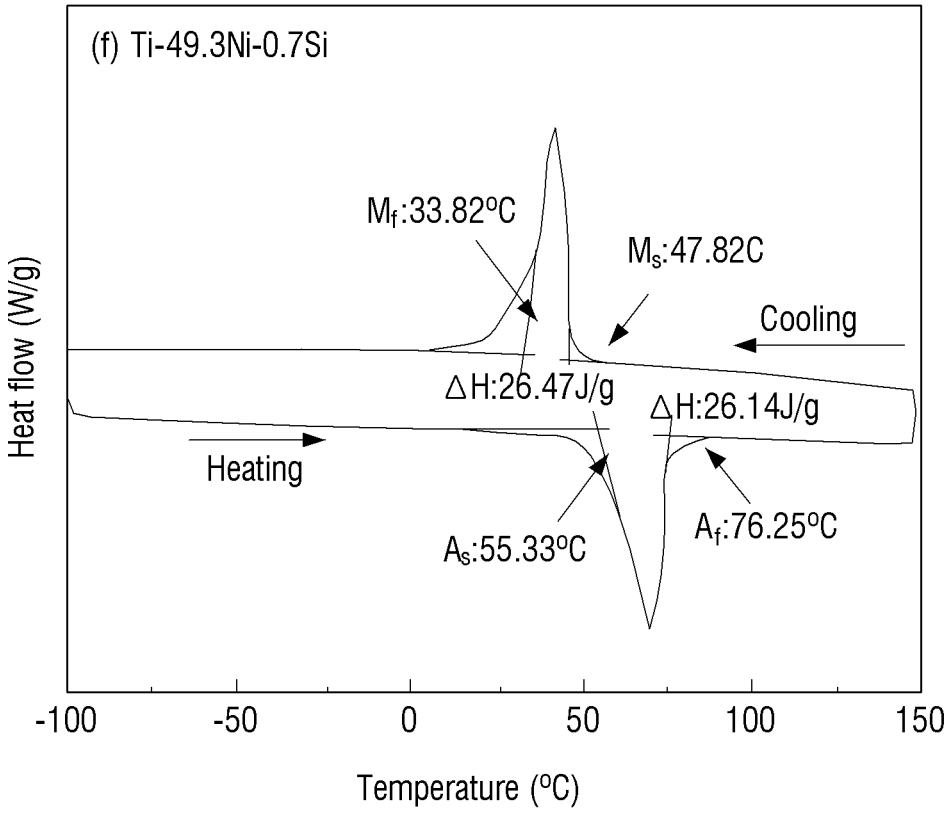

It can be seen from FIG. 6 that in 50Ti-49.3Ni-0.7Si, the martensitic transformation start temperature $M_s$ is 47.82° C., the martensitic transformation finish temperature $M_f$ is 33.82° C., the austenite transformation start temperature $A_s$ is 55.33° C., and the austenite transformation finish temperature $A_f$ is 76.25° C.

Figure 7:
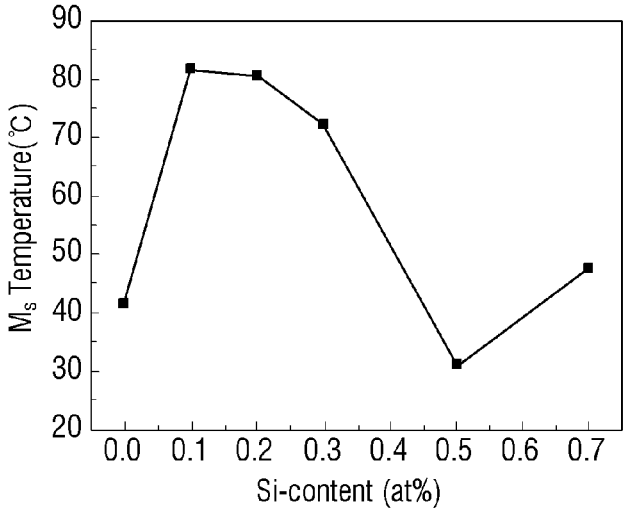
FIG. 7 is a diagram illustrating a summary of martensitic transformation start temperatures $M_s$ of shape memory alloys according to a comparative example and various embodiments of the present invention.

FIG. 7 is a diagram illustrating a summary of the martensitic transformation start temperatures $M_s$ in the compositions derived from the experiment results of FIGS. 1 to 6. It can be seen from FIG. 7 that when the Si content is within a range of about 0.1 at. % to 0.3 at. %, the martensitic transformation start temperature $M_s$ is a relatively high-temperature in a range of about 72° C. to 82° C. It was understood that the martensitic transformation start temperature $M_s$ is most highly represented in the temperature range when the Si content is 0.1 at. %. It was understood that the martensitic transformation start temperature $M_s$ is not much increased when the Si content is less than 0.1 at. % or more than 0.3 at. %.

In sum, it can be concluded from the experiment results that when a very small amount of Si in a range of about 0.1 at. % to 0.3 at. % is added to the Ti—Ni binary alloy, the shape memory alloy suitable for a high-temperature shape memory alloy may be obtained, and when the Si content is less than 0.1 at. % or more than 0.3 at. %, the shape memory alloy is not suitable for a high-temperature shape memory alloy.

Figure 8:
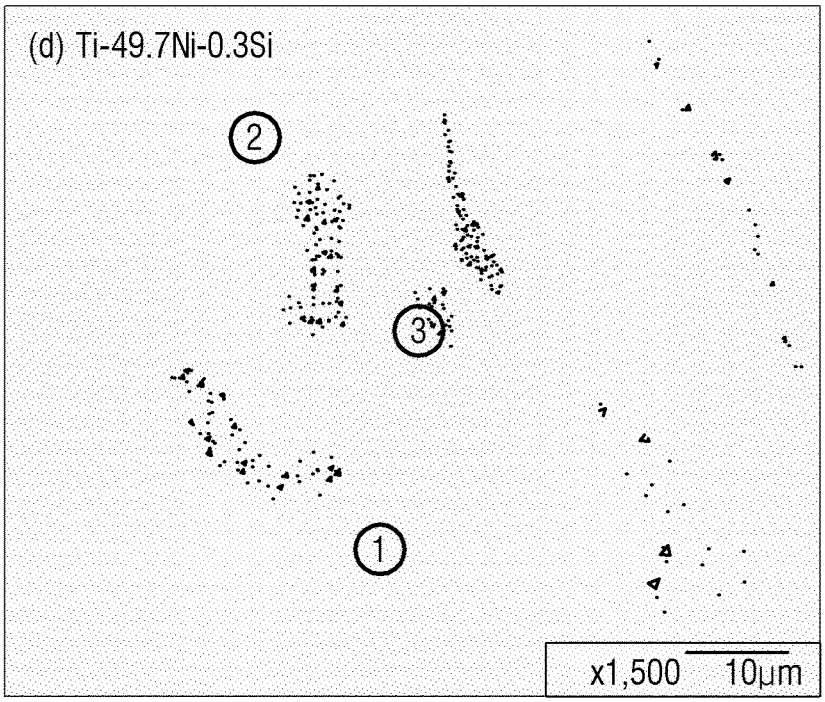
FIGS. 8 to 10 are diagrams illustrating results of performing electron probe X-ray micro analyzer (EPMA) to observe microstructures of shape memory alloys according to various embodiments of the present invention.
Figure 9:
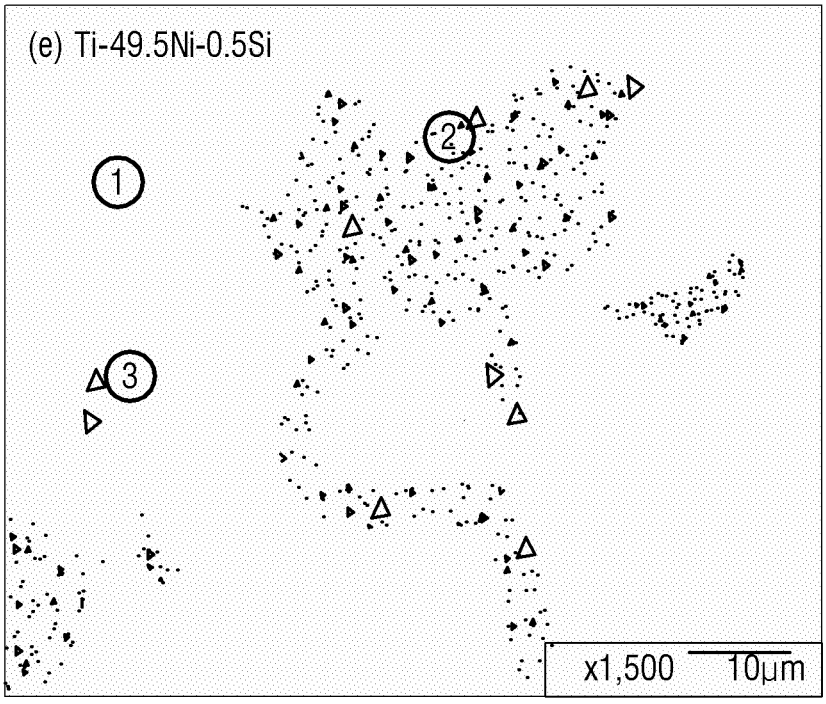
Figure 10:
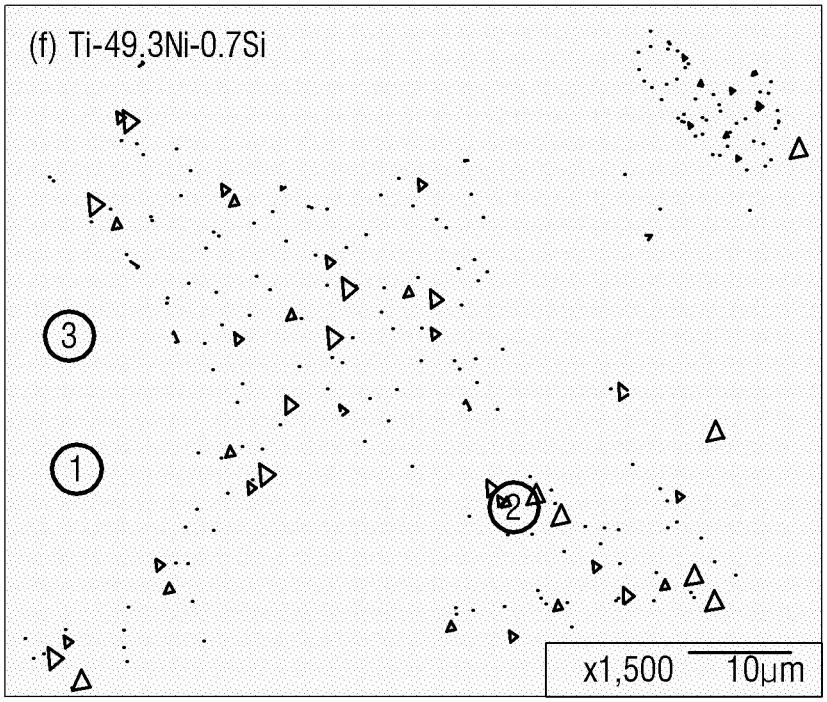

FIGS. 8 to 10 illustrate back scattered electron images (BSEs) as results of performing electron probe X-ray micro analyzer (EPMA) to observe a microstructure of an alloy. Energy dispersive X-ray spectro-meter (EDS) was performed to analyze a composition of the alloy.

Specifically, FIGS. 8 to 10 illustrate back scattered electron images (BSEs) and results of point analysis and area analysis with respect to 50Ti-49.7Ni-0.3Si, 50Ti-49.5Ni-0.5Si, and 50Ti-49.3Ni-0.7Si. A gray phase ② and a black phase ③ in a base indicated by ① were observed. It can be seen that since Si is not observed in the base, solid solution of Si is not solid-solutionized in the base.

Figure 11:
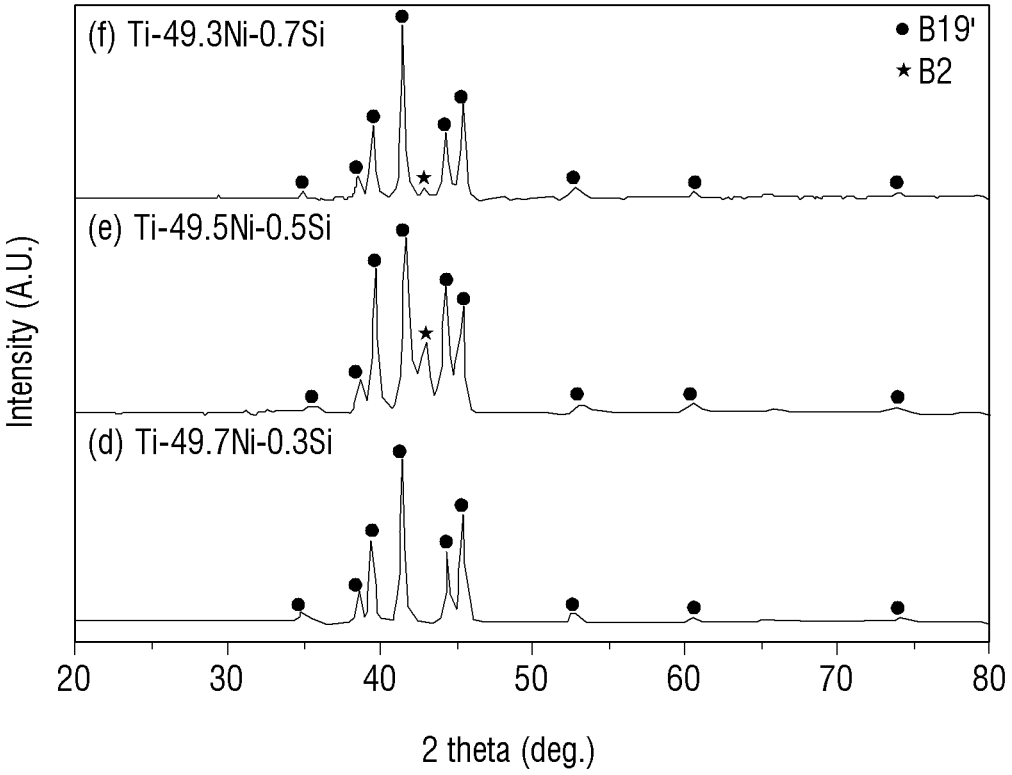
FIG. 11 is a diagram a result of performing an X-ray diffraction test at room temperature for crystal structure interpretation and phase analysis of shape memory alloys according to various embodiments of the present invention.

FIG. 11 illustrates a result of performing an X-ray diffraction test in room temperature for crystal structure interpretation and phase analysis of an alloy. Specifically, a Cu Ka ray was used and a scanning speed was 2°/min. 2θ was measured in a range of 20° to 80°.

It can be seen from FIG. 11 that in 50Ti-49.5Ni-0.5Si, 50Ti-49.3Ni-0.7Si, and 50Ti-49.7Ni-0.3Si alloys, only a B19' (monoclinic martensite) phase and a B2 (cubic) phase are observed at room temperature, and a Si compound is not observed.

The Ti content was fixed to 50 at. % in the above-described example, but the Ti content was further increased to increase the martensitic transformation start temperature $M_s$. At this time, the Si content was in the range of 0.1 at. % to 0.3 at. % which is the optimum content range derived from the above-described experiment. It could be seen from the experiment result that the alloy containing Ti of below 50.5 at. % is suitable for a high-temperature alloy. This is because when Ti is equal to or more than 50.5 at. %, the transformation temperature is reduced due to $Ti_2Ni$ formation.

Hereinafter, examples that the Si content is changed to 0.1, 0.2, and 0.3 at. % in a state that Ti is fixed to 50.2 at. % will be described.

To prepare an alloy, an alloy ingot was prepared in an Ar atmosphere by dissolving sponge Ti (purity 99.7%), granular Ni (purity 99.9%), and Si (purity 99.9%) using an arc melting method. Three compositions of alloy were prepared: 50.2Ti-(49.8−x)Ni-xSi (x=0.1, 0.2, and 0.3) (at. %).

The prepared alloy was maintained at 850° C. for 1 hour for the homogenization of a microstructure and an ingredient, was subjected to a cold solution treatment in the iced water, and was subjected to differential scanning calorimetry (DSC). To prevent oxidation of the sample, the alloy was tested while allowing nitrogen gas to flow at a rate of 80 ml/min. A cooling rate and a heating rate were 0.17 K/sec, and liquid nitrogen was used in the cooling. A temperature of an exothermic peak of a DSC curve was measured as a martensitic transformation temperature, and a temperature of an endothermic peak of the DSC curve was measured as an austenite transformation temperature. The results are shown in FIGS. 12 to 14.

Figure 12:
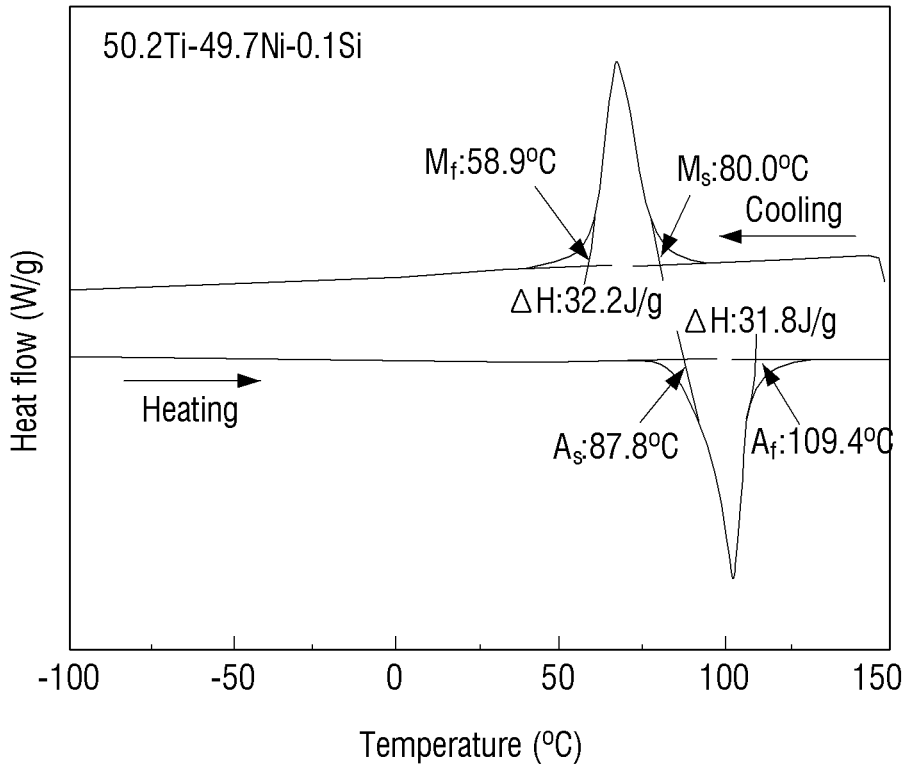
FIGS. 12 to 14 are diagrams illustrating differential scanning calorimetry results of shape memory alloys according to other various embodiments of the present invention.
Figure 13:
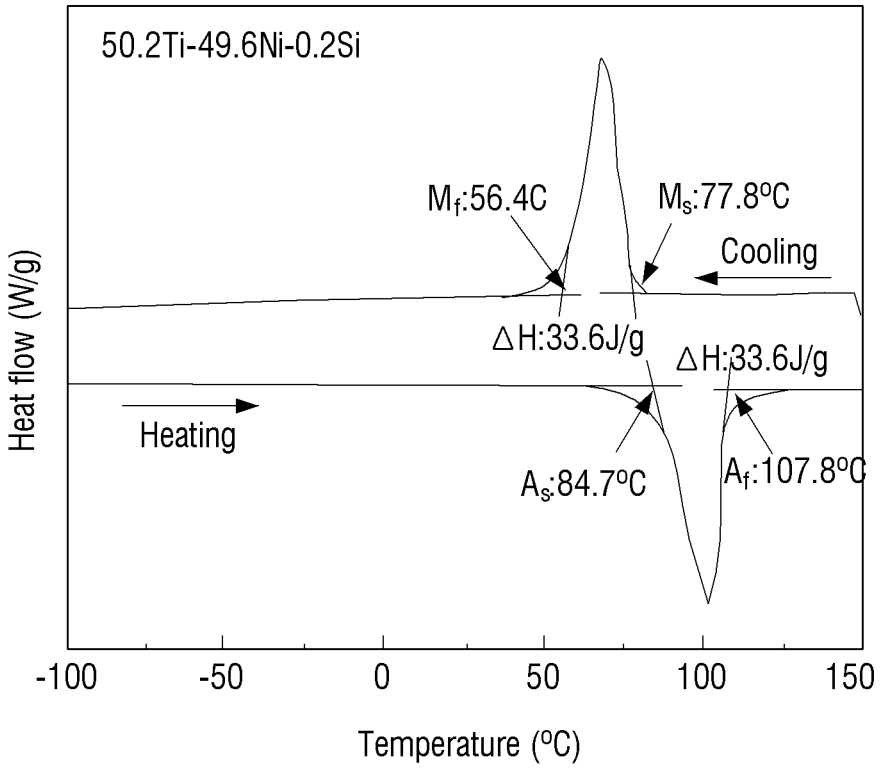
Figure 14:
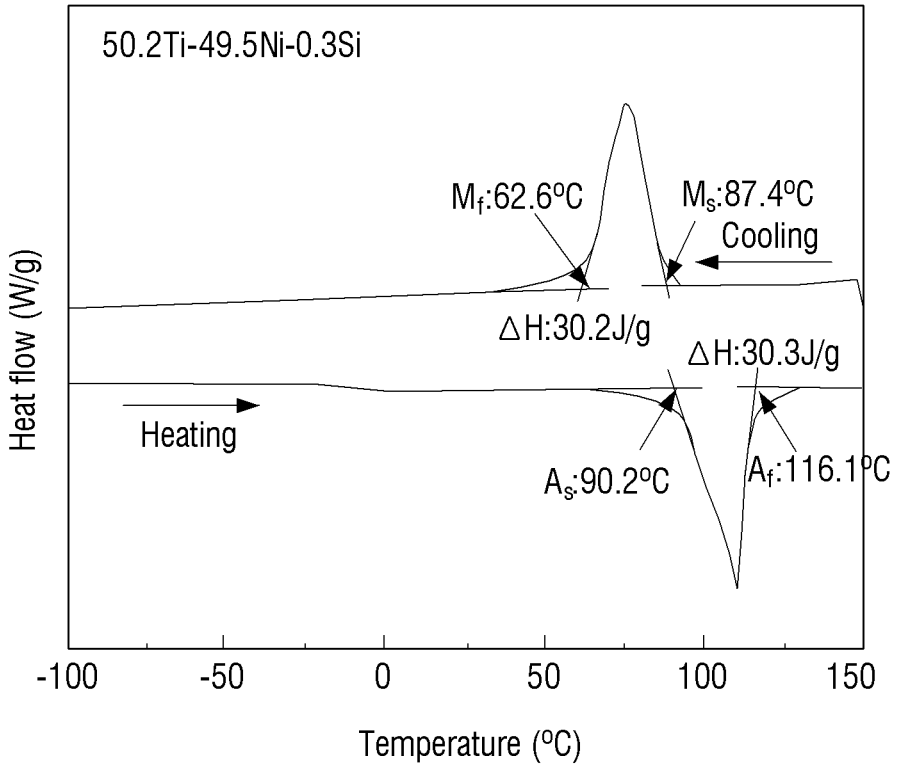

FIGS. 12 to 14 are diagrams illustrating results of performing differential scanning calorimetry (DSC) after the solution treatment is performed at 850° C. for 1 hour to inspect a phase transformation behavior and a transformation temperature.

Specifically, it can be seen from FIG. 12 that in 50.2Ti-49.7Ni-0.1Si, the martensitic transformation start temperature $M_s$ is 80.0° C., the martensitic transformation finish temperature $M_f$ is 58.9° C., the austenite transformation start temperature $A_s$ is 87.8° C., and the austenite transformation finish temperature $A_f$ is 109.4° C.

It can be seen from FIG. 13 that in 50.2Ti-49.6Ni-0.2Si, the martensitic transformation start temperature $M_s$ is 77.8° C., the martensitic transformation finish temperature $M_f$ is 56.4° C., the austenite transformation start temperature $A_s$ is 84.7° C., and the austenite transformation finish temperature $A_f$ is 107.8° C.

It can be seen from FIG. 14 that in 50.2Ti-49.5Ni-0.3Si, the martensitic transformation start temperature $M_s$ is 87.4° C., the martensitic transformation finish temperature $M_f$ is 62.6° C., the austenite transformation start temperature $A_s$ is 90.2° C., and the austenite transformation finish temperature $A_f$ is 116.1° C.

Figure 15:
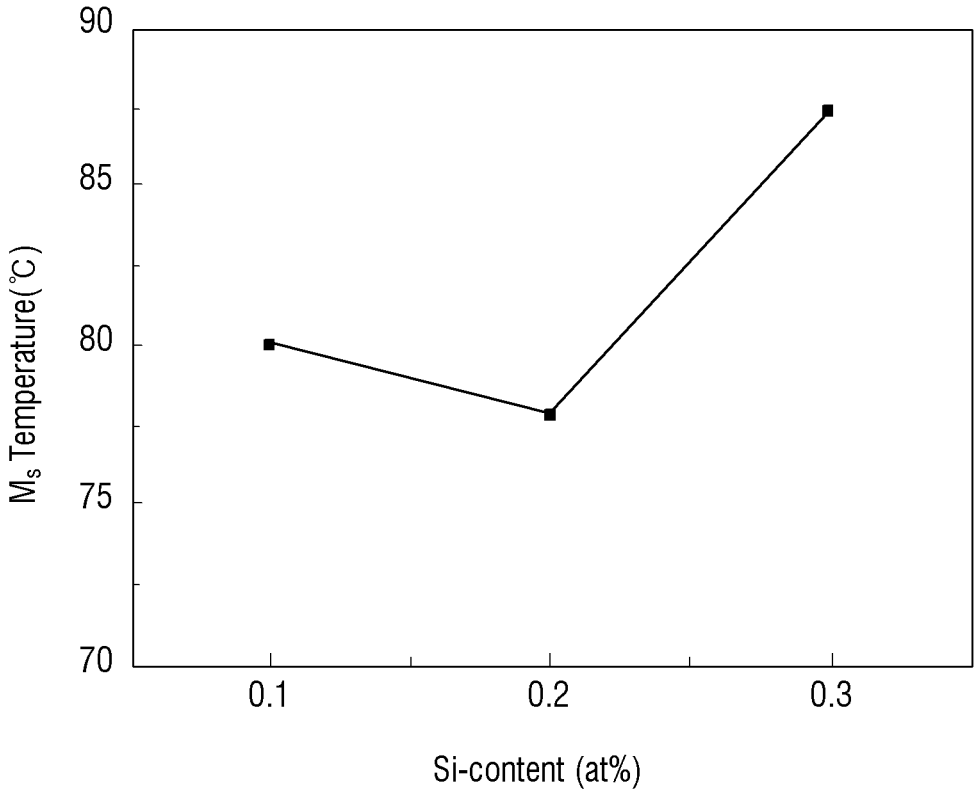
FIG. 15 is a diagram illustrating a summary of martensitic transformation start temperatures $M_s$ of shape memory alloys according to other various embodiments of the present invention.

FIG. 15 is a diagram illustrating a summary of the martensitic transformation start temperatures $M_s$ in the compositions derived from the experiment results of FIGS. 12 to 14. It was understood that as compared with the result of FIG. 7, in response to Ti of 50 at. %, the martensitic transformation start temperature $M_s$ is most highly represented when the Si content is 0.1 at. %. However, it was understood that in response to Ti of 50.2 at. %, the martensitic transformation start temperature $M_s$ is most highly represented when the Si content is 0.3 at. %.

In sum, it can be concluded from the experiment results that the total three composition alloys of 50.2Ti-(49.8−x)Ni-xSi (x=0.1, 0.2, and 0.3) (at. %) are also suitable for a high-temperature shape memory alloy.

To investigate the reason that the martensitic transformation start temperature $M_s$ is represented to be high in the alloys of the 50.2Ti-(49.8−x)Ni-xSi (x=0.1, 0.2, and 0.3) compositions, the XRD analysis and the EPMA analysis were performed, but the phase corresponding to the reason was not observed. However, with reference to M. Zarinejad et. al (Zarinejad, Mehrdad, and Yong Liu) "Dependence of transformation temperatures of shape memory alloys on the number and concentration of valence electrons" in Shape memory alloys: manufacture, properties and applications, New York: Nova Science Publishers (2009), it was reported that the transformation temperature of the shape memory alloy is influenced by the number of valence electrons per atom ($e_v/a$) and the valence electron concentration ($C_v$) as well as the alloy composition. Based on the publication, the number of valence electrons per atom ($e_v/a$) and the valence electron concentration ($C_v$) with respect to the above-described various alloy compositions were analyzed. The austenite transformation start temperature $A_s$, the martensitic transformation start temperature $M_s$, the number of valence electrons per atom ($e_v/a$), and the valence electron concentration ($C_v$) with respect to the above-described various alloy compositions are summarized in the following Table 1.

TABLE 1

| Composition | $A_s$ temperature (° C.) | $M_s$ temperature (° C.) | $e_v/a$ (e atom$^{-1}$) | $C_v$ |
|---|---|---|---|---|
| Ti—50Ni | 53.9 | 41.5 | 7 | 0.28 |
| Ti—49.9Ni—0.1Si | 88.7 | 81.9 | 6.994 | 0.2799 |
| Ti—49.8Ni—0.2Si | 79.9 | 80.8 | 6.988 | 0.2798 |
| Ti—49.7Ni—0.3Si | 79 | 72.3 | 6.982 | 0.2797 |
| Ti—49.5Ni—0.5Si | 45.9 | 31.4 | 6.97 | 0.2795 |
| Ti—49.3Ni—0.7Si | 55.3 | 47.8 | 6.951 | 0.2791 |
| 50.2Ti—49.7Ni—0.1Si | 87.8 | 80 | 6.982 | 0.27957 |
| 50.2Ti—49.6Ni—0.2 Si | 84.7 | 77.8 | 6.976 | 0.27948 |
| 50.2Ti—49.5Ni—0.3 Si | 90.2 | 87.4 | 6.97 | 0.2794 |

Based on the above-described analysis results, it can be concluded that the transformation temperature of the shape memory alloy according to various embodiments of the present invention is correlated with the number of valence electrons or the valence electron concentration.

The B2 (Cubic) phase, the B19' (Monoclinic) phase, and the R (Rhombohedral) phase as a middle phase are appeared in the Ti—Ni shape memory alloy. Three different martensitic transformations B2-R, R-B19', and B2-B19' are appeared between the three phases. When the heat cycle, the thermomechanical treatment, and the like are accomplished in the B2↔B19' transformation, the R phase as the middle phase may be appeared, and the B2↔R↔B19' two-stage transformation may occur. Since the R-B19' transformation and the B2-B19' transformation have large transformation strain and large transformation hysteresis, a structural defect of a microstructure is caused by large lattice deformation due to repetitive transformation, and thus thermomechanical stability is degraded. However, the transformation strain and the transformation history according to the B2-R transformation are very large as 7% and 50 K, respectively, but the transformation strain and the transformation history according to the B2↔R transformation are very small as 0.8% and 2 K, respectively, and thus the B2↔R transformation has small transformation hysteresis. Accordingly, the B2↔R transformation has less structural defect even in the repetitive transformation and has high reversibility and high heat response rate. Therefore, the alloy is suitable for application to the driving device field.

For application of a shape memory characteristic of the B2↔R transformation, the thermomechanical treatment (TMT) was further performed.

Specifically, 25% cold rolling on the 50.2Ti-49.5Ni-0.3Si was performed, and the 50.2Ti-49.5Ni-0.3Si alloy was heat-treated at temperatures of 400° C., 450° C., 500° C., 550° C., and 600° C. for 1 hour through the thermomechanical treatment (TMT). DSC curves of the thermomechanically treated 50.2Ti-49.5Ni-0.3Si alloy were shown in FIGS. 16 to 21.

In FIGS. 16 to 21, a peak starting at an R transformation start temperature $T_R$ is caused by the B2→R transformation, a peak starting at $M_s$ is caused by the R→B19' transformation. It was understood from the experiment results that in the heat treatment at temperatures of 400° C., 450° C., 500° C., 550° C., and 600° C., the R phase is induced, and thus the B2-R-B19' two-stage phase transformation is appeared.

Figure 16:
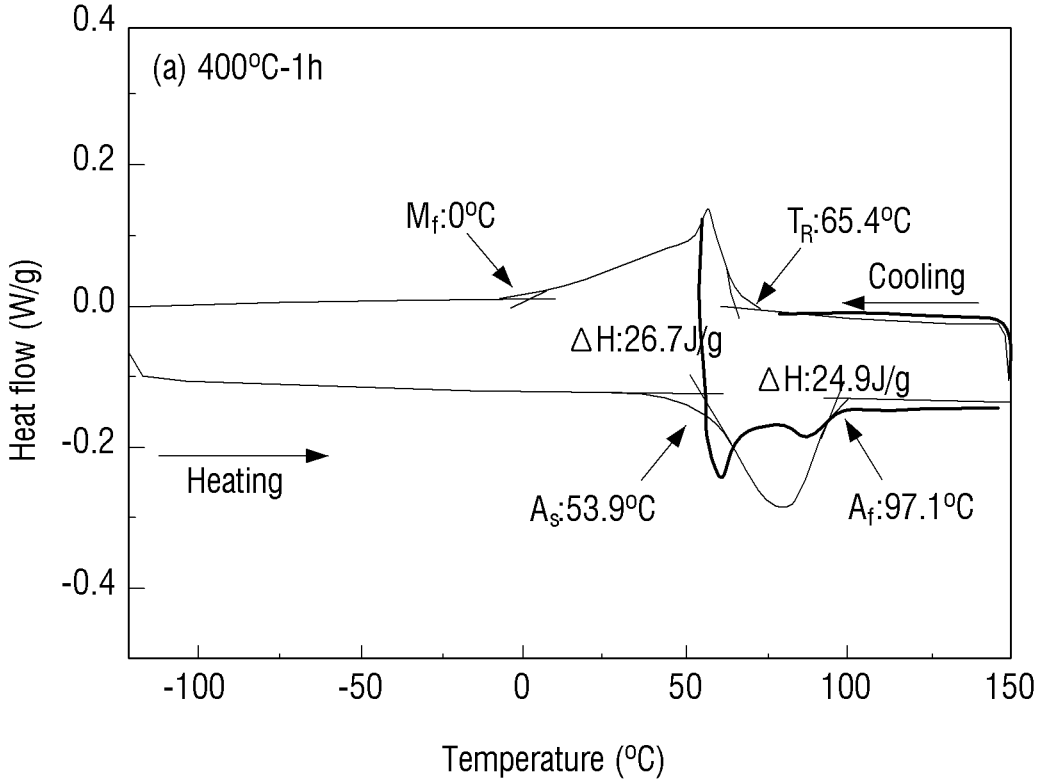
FIGS. 16 to 21 are diagrams illustrating differential scanning calorimetry results of a shape memory alloy, which is subjected to a thermomechanical treatment, according to an embodiment of the present invention.

Specifically, it can be seen from FIG. 16 that $T_R$ of the 50.2Ti-49.5Ni-0.3Si alloy which is heat-treated at 400° C. for 1 hour is 65.4° C.

Figure 17:
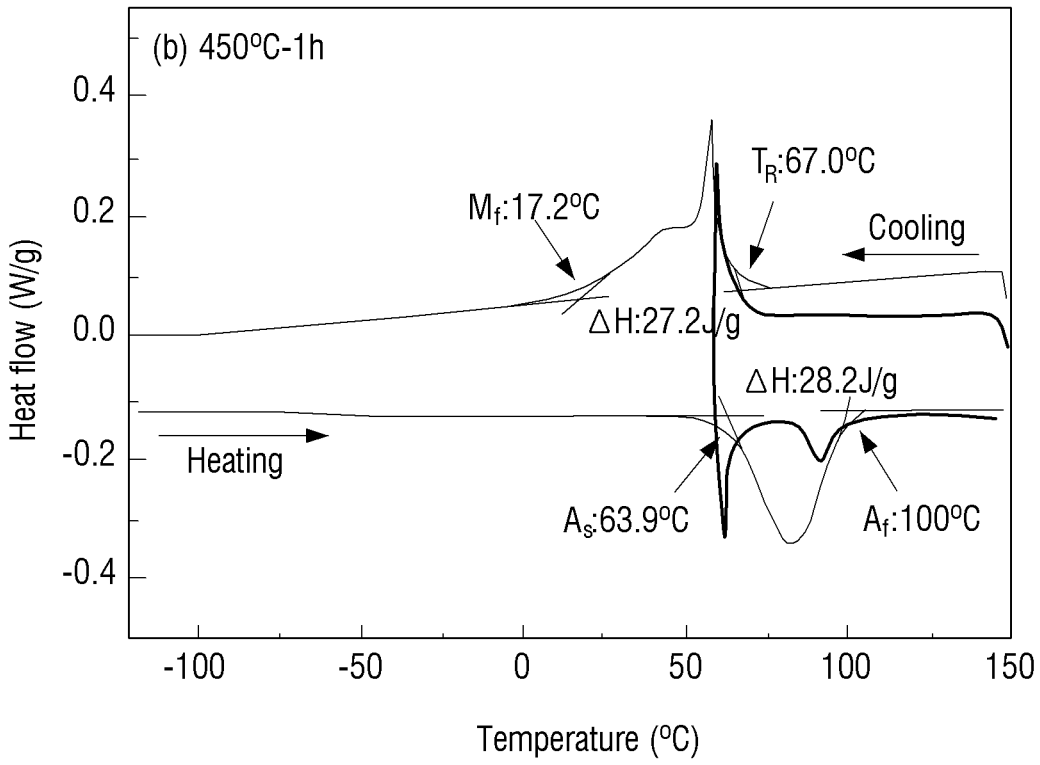

It can be seen from FIG. 17 that $T_R$ of the 50.2Ti-49.5Ni-0.3Si alloy which is heat-treated at 450° C. for 1 hour is 67.0° C.

Figure 18:
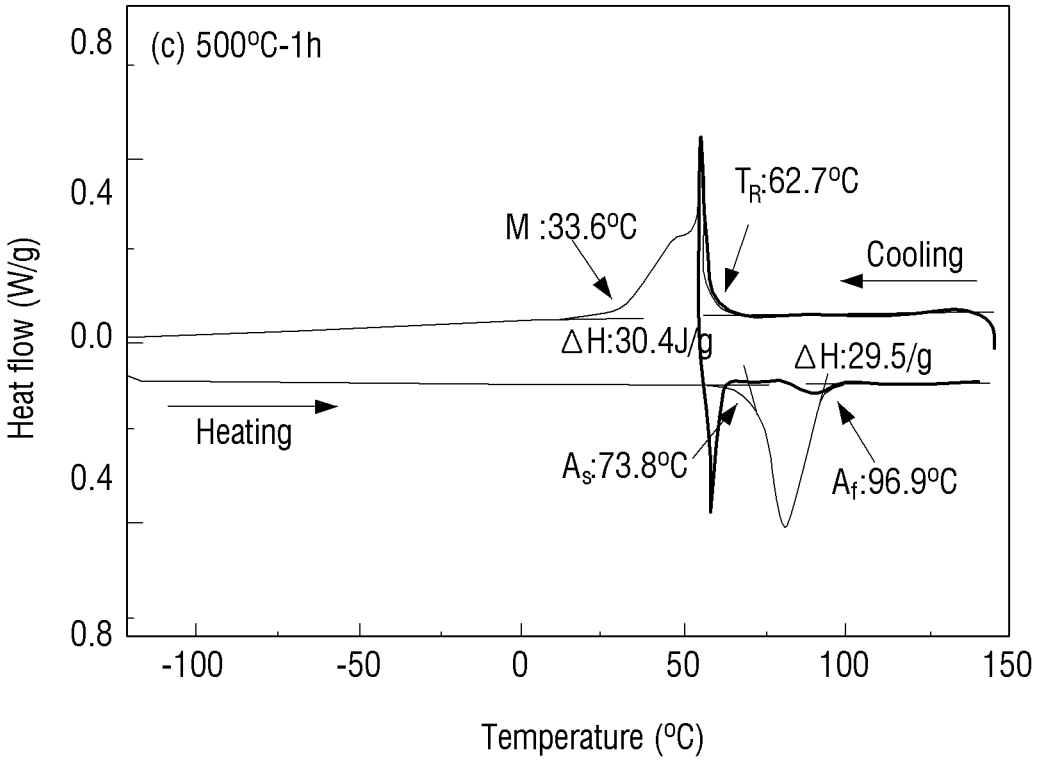

It can be seen from FIG. 18 that $T_R$ of the 50.2Ti-49.5Ni-0.3Si alloy which is heat-treated at 500° C. for 1 hour is 62.7° C.

Figure 19:
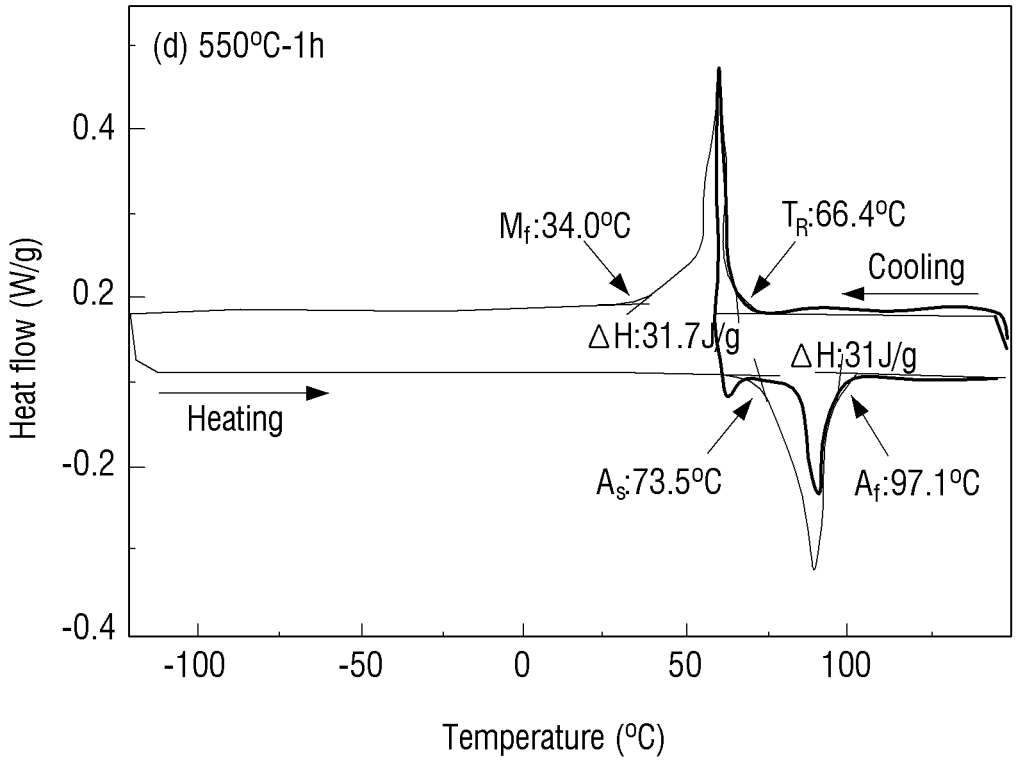

It can be seen from FIG. 19 that $T_R$ of the 50.2Ti-49.5Ni-0.3Si alloy which is heat-treated at 550° C. for 1 hour is 66.4° C.

Figure 20:
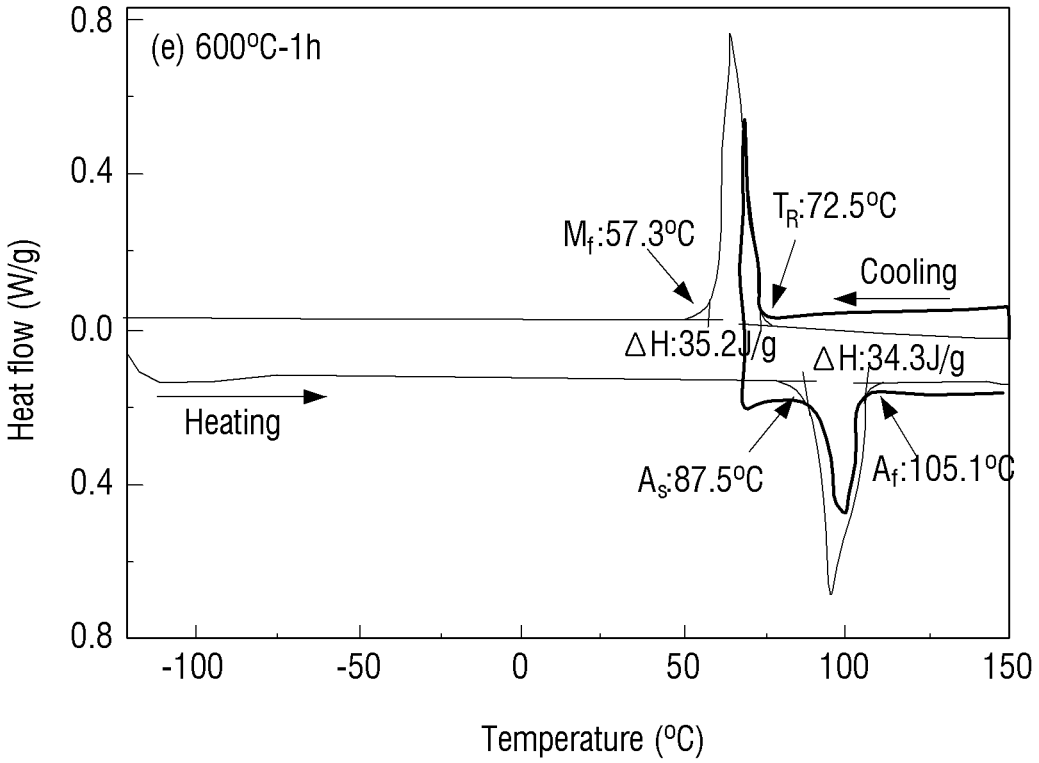

It can be seen from FIG. 20 that $T_R$ of the 50.2Ti-49.5Ni-0.3Si alloy which is heat-treated at 600° C. for 1 hour is 72.5° C.

Figure 21:
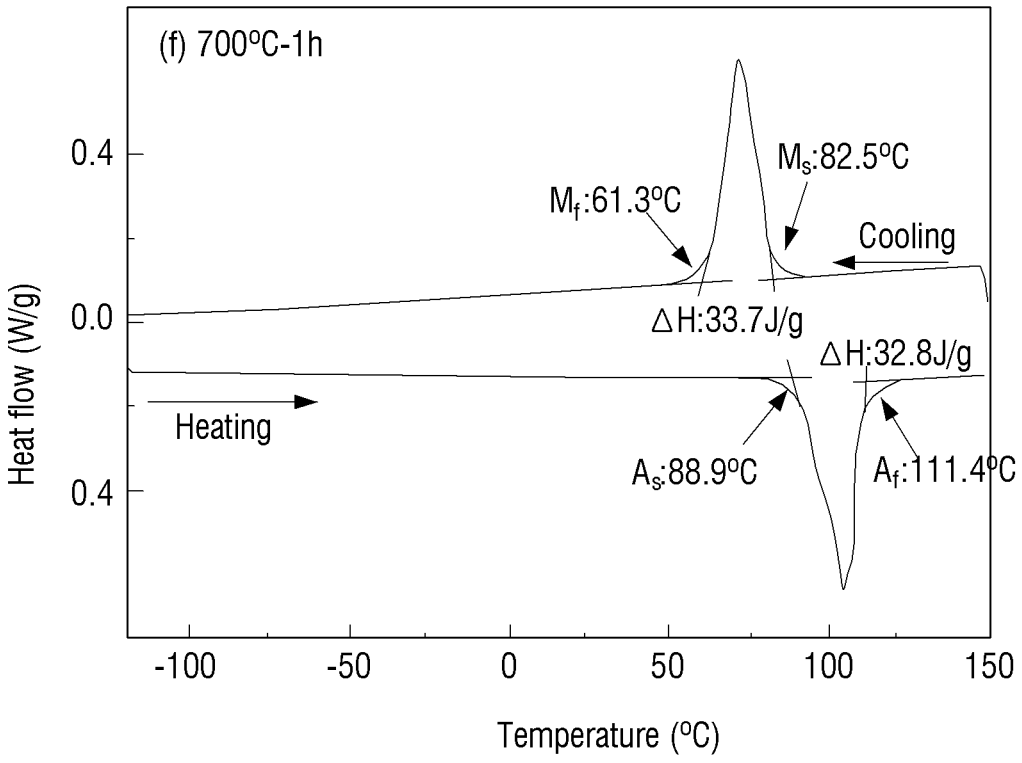

It can be seen from FIG. 21 that the R phase is not induced in the 50.2Ti-49.5Ni-0.3Si alloy which is heat-treated at 700° C. for 1 hour. It is determined that as recrystallization occurs at a temperature of 700° C. or more, the dislocation effect is gradually disappeared, and thus the R phase is not induced.

Figure 22:
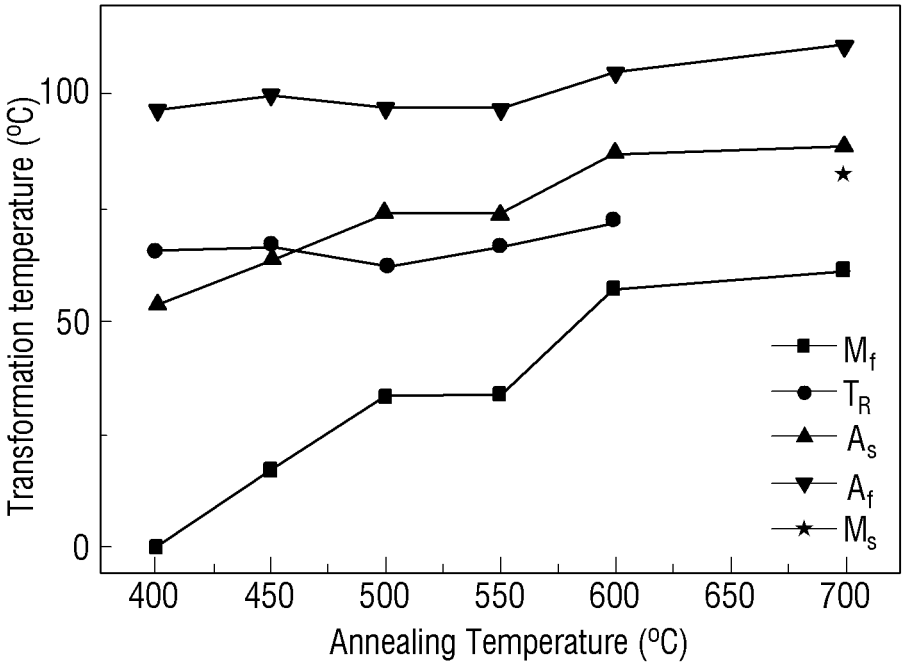
FIG. 22 is a diagram illustrating a result of summarizing transformation temperatures of a shape memory alloy, which is subjected to a thermomechanical treatment, according to an annealing temperature according to an embodiment of the present invention.

The result that the transformation temperatures are summarized with respect to the heat treatment temperatures after the transformation temperatures are measured from the DSC curves of FIGS. 16 to 21 was shown in FIG. 22.

It can be seen from FIG. 22 that $T_R$ with respect to the heat treatment temperatures is formed at a temperature of about 67° C. on average, and $T_R$ is 10° C. equal to or larger than the temperature of 50° C. reported in the shape memory alloy in the related art. Accordingly, the shape memory alloy according to the present invention is suitable for parts of a device used at a high temperature, that is, a high-temperature actuator.

The composition ratio of the alloy in the above-described examples is described in an accurate numerical value, but the composition of the shape memory alloy of the present invention is not limited to the composition having an accurate corresponding ratio. This is because the shape memory alloy may be prepared with a different composition ratio within a tolerance in an actual manufacturing process, and impurities may be necessarily added.

The foregoing exemplary embodiments and advantages are merely exemplary and are not to be construed as limiting the present inventive concept. The description of the exemplary embodiments is intended to be illustrative, and not to limit the scope of the claims, and many alternatives, modifications, and variations will be apparent to those skilled in the art.

The invention claimed is:

1. A shape memory alloy composed of Ti, Ni, and Si, wherein Si is contained in an amount of 0.1 to 0.3 at. %.

2. The shape memory alloy according to claim 1, wherein the shape memory alloy is composed of 50Ti-(50−x)Ni-xSi (at. %) ($0.1 \le x \le 0.3$).

3. The shape memory alloy according to claim 1, wherein the shape memory alloy is composed of 50.2Ti-(49.8−x)Ni-xSi (at. %) ($0.1 \le x \le 0.3$).

4. The shape memory alloy according to claim 1, wherein the shape memory alloy has a martensitic transformation start temperature $M_s$ in a range of 70° C. to 90° C.

5. The shape memory alloy according to claim 1, wherein phase transformation to an R (rhombohedral) phase from a B (cubic) phase in the shape memory alloy occurs in a specific temperature range.

6. The shape memory alloy according to claim 5, wherein the phase transformation occurs in a temperature range of between 60° C. to 75° C.

7. An actuator which operates according to temperature change, the actuator being composed of the shape memory alloy according to claim 1.

* * * * *